United States Patent [19]

Newbold

[11] Patent Number: 4,918,949

[45] Date of Patent: Apr. 24, 1990

[54] TAMPER-RESISTANT LOCK

[75] Inventor: Dixon Newbold, Glocester Providence, R.I.

[73] Assignee: Rhode Gear USA, Providence, R.I.

[21] Appl. No.: 173,455

[22] Filed: Mar. 25, 1988

[51] Int. Cl.[5] ..... E05B 67/22

[52] U.S. Cl. ..... 70/38 A; 70/39; 70/417

[58] Field of Search ..... 70/38 A, 38 R, 38 B, 70/38 C, 39, 20, 54, 56, 417

[56] References Cited

U.S. PATENT DOCUMENTS

| | | | |
|---|---|---|---|
| 4,070,879 | 1/1978 | Thompson | 70/20 |
| 4,545,224 | 10/1985 | Zane | 70/39 |
| 4,584,855 | 4/1986 | Burlingame | 70/39 |

*Primary Examiner*—Robert L. Wolfe

*Attorney, Agent, or Firm*—Shoemaker and Mattare, Ltd.

[57] ABSTRACT

A lock having a shackle and housing in which the shackle is a symmetrical, U-shaped member with spaced, parallel, identically configured legs having free ends, and the housing has a pair of spaced openings in one side thereof for receiving the free ends of the shackle. Either end of the shackle may be inserted into either opening, and detent means are provided in the housing in association with the openings to retain the ends of the shackle in the openings. One of the detent means is fixed and the other has a movable portion to enable the associated end of the shackle to be engaged and disengaged relative thereto. A lock mechanism in the housing is operable to secure the movable detent means against movement to lock the shackle in the housing. In one form of the invention, a reinforcing sleeve is placed around the housing in the area of the lock mechanism to prevent damage to the housing and lock mechanism.

12 Claims, 2 Drawing Sheets

TAMPER-RESISTANT LOCK

BACKGROUND OF THE INVENTION

This application relates to locks, and, in particular, to a lock that may be used for locking bicycles, cycles, and other articles in which the lock has a relatively large shackle.

PRIOR ART

The present invention is directed to the type of lock conventionally used for bicycles and motorcycles. These locks ordinarily comprise a relatively large U-shaped shackle that engages an elongated housing.

Conventional locks of this type are necessarily designed with large shackles adapted to engage bulky components of a bicycle. These locks are designed to minimize damage to the locks resulting from tampering with the lock. Frequently, those attempting to force open bicycle and cycle locks that have shackle ends projecting through the housing use leverage means, such as pipes, to engage the housing or free ends of the shackle. Additionally, efforts are made to force open these locks by hammering on the free ends of the shackle or the housing. Prior art locks are particularly susceptible to tampering in the manner described, usually by damaging the housing end which contains the lock cylinder.

Currently, some locks are made with the free ends of the lock shackle secured and confined within the elongated housing. These locks minimize the likelihood of forceful opening of the lock by hammering on the shackle ends, and, in some cases, by using leverage means on the shackle ends. In these designs, the shackle typically has one end bent to form a foot that is engaged in a hole in the housing, and the other end is shaped to be engaged by a lock mechanism in the housing. However, such locks permit engagement of the shackle with the housing in one orientation only, and with such locks users frequently put the shackle into the housing incorrectly. In addition, the ends of the lock housing, and particularly the end containing the lock cylinder, are susceptible to being damaged, thereby freeing the shackle.

An example of one prior art device is described in U.S. Pat. No. 4,155,231. In the device described in this patent, the shackle 16 has a foot 26 on one end, whereby when the shackle is engaged with the lock housing 18, both ends of the shackle are confined within the housing. The shackle is not symmetrical and must be inserted with the same leg in the same hole each time.

SUMMARY OF THE INVENTION

It is therefore an object of the present invention to provide an improved lock particularly useful for bicycles and cycles, in which the free ends of the shackle are secured and confined within a housing, and with the shackle shaped to permit easy interengagement with the housing.

A further object of the present invention is to provide a lock having a shackle that is symmetrically configured and arranged for ease in manufacture, handling and use, and in which either end of the shackle may be inserted into the opening at either end of the housing.

A still further object of the invention is to provide an improved locking mechanism in which the end of the housing containing the lock cylinder is reinforced to resist damage thereto.

Another object of the invention is to provide an improved lock mechanism that is designed to minimize damage thereto resulting from tampering, is easy to assemble and use, and is simple and attractive in appearance and difficult to force open.

Yet another object of the present invention is to provide an improved lock design that minimizes projections that may damage or scratch a bicycle or other article secured by the lock mechanism.

A still further object of the invention is to provide a lock mechanism that is easily used, and by which an article may be secured without concern about the orientation of the shackle in respect to the housing.

BRIEF DESCRIPTION OF THE DRAWINGS

These and other objects and advantages of the invention will become apparent from the following detailed description and claims, when taken in conjunction with the drawings, wherein like reference characters designate like parts throughout the several views, and wherein:

DETAILED DESCRIPTION OF THE PREFERRED EMBODIMENTS

The present invention is made of a suitable material, such as steel, conventionally employed in bicycle locks and the like. The particular embodiments described herein are especially suited for use in conjunction with bicycles, although locks designed for other specific purposes are contemplated without departing from the scope of this invention.

Figure 1:
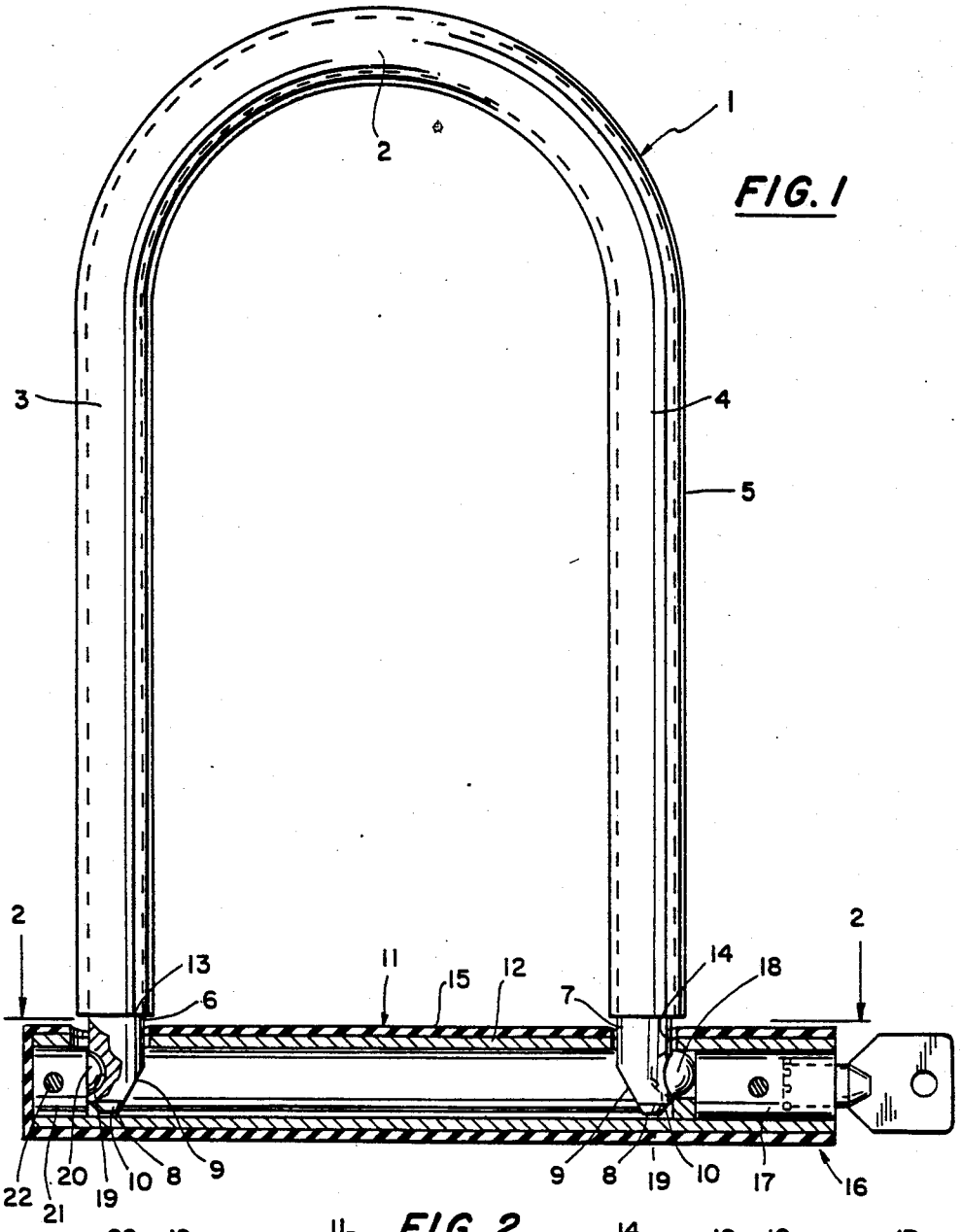
FIG. 1 is a view in elevation, with parts shown in section, of a lock embodying the invention.
Figure 2:
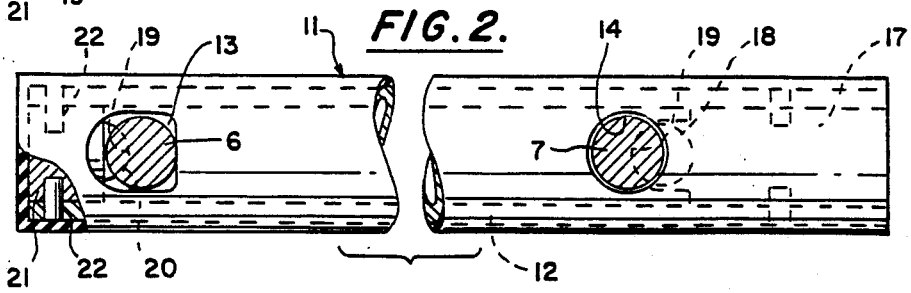
FIG. 2 is a cross-sectional view taken along the line 2—2 in FIG. 1.

In the embodiment illustrated in FIGS. 1 and 2, a U-shaped shackle 1 is formed with a bight portion 2 and a pair of elongate, parallel, spaced apart legs 3 and 4. The shackle is preferably approximately four to five inches in width and approximately six to eight inches in length, and formed of a suitable, hardened steel. The shackle may be covered with a protective rubber or synthetic rubber-like coating 5 to prevent scratching of the components of a bicycle or the like with which it is used.

The free ends 6 and 7, respectively, of the legs 3 and 4 are symmetrical in configuration and are parallel to one another. Each of the free ends is formed with a foot having a flattened end 8 and a beveled segment 9 on the inner, facing edges. In the specific example illustrated, the beveled segments 9 extend at an angle of approximately 60° relative to the planes of the flattened free ends 8, and the length of each beveled segment 9 is preferably in the order of about one-half to three-quarters of an inch. The free ends 6 and 7 of the legs 3 and 4 are also formed with a chamfer 10 of approximately 45° extending around the periphery of the flattened end 8. The shape and dimensioning of these elements at the free ends 6 and 7 are, as noted above, preferably symmetrical and identical with one another, but the specific dimensions may be varied without departing from the spirit and scope of the invention.

The housing 11 comprises an elongated tubular steel member 12 with a pair of openings 13 and 14 formed through one side in spaced relationship to one another and forming means to receive the free ends 6 and 7 of the shackle. The housing 11 may also be suitably covered with a rubber or other synthetic rubber-like material 15 to protect against scratching of the article being held by the lock.

One end 16 of the housing is provided with a lock mechanism 17, which may be of conventional design. The lock mechanism is preferably a barrel type lock having a ball detent 18 that can be fixed against movement, when locked, in the position shown in FIG. 1; and when unlocked, is free to move to the right as viewed in FIG. 1. The ball detent 18 is shaped and sized to conform with and engage in locking relationship with a corresponding recess 19 formed in the side of each of the free ends 6 and 7 of the legs 3 and 4. The symmetry of the shackle and the recesses 19 permit the insertion of the shackle 1 with either leg 3 or 4 positioned within the opening 14 and the other leg positioned in the opening 13. In either orientation, the free ends of the shackle may be locked in the housing by interengaging and securing the ball detent 18 in the recess 19.

The leg 3 or 4 which is received in the opening 13 is secured by the interengagement of the recess 19 in that leg with a fixed detent 20. The fixed detent 20 comprises a plug 21 which is secured in the end of the tubular member 12 with the detent 20 shaped, sized, and positioned to engage one or the other of the recesses 19 upon full insertion of the shackle free ends into the openings 13 and 14. The detent 20, which is formed as a part of the plug 21, is secured by a pair of pins 22, preferably secured in radially opposite directions through the wall of the tubular member 12 into the plug 21. Typically, the pins 22 may be inserted about a quarter of an inch in from the ends of the tubular member 12 and may comprise bar stock in the order of 5/32 of an inch in diameter and a quarter of an inch in length, with the pins 22 projecting an eighth of an inch into the plug. The pins 22 may be suitably and permanently secured in the end of the housing 12, thereby permanently securing and fixing the plug 21.

As illustrated in FIG. 2, the openings 13 and 14 have different shapes. The opening 14 is circular in shape and has a diameter slightly greater than the diameter of the free end 4 of the shackle. The opening 13, however, is D-shaped in configuration and is significantly larger than the diameter of the free end of the shackle in a direction parallel to the length of the housing 11. The D-shaped opening 13 is formed with a curved end 22 and a flat end 23, aligned longitudinally with respect to the length of the housing and at a location such that the curved end is positioned above the base of the fixed detent 20.

In use, either free end 6 or 7 is first inserted into the opening 13, with the free end being disposed at an angle of about 60°, such that the beveled surface 9 slides into the opening 13 adjacent the flat end 23 of the opening and in a direction perpendicular to the length of the housing. When the recess 19 with the free end thus inserted engages the fixed detent 20, the shackle is pivoted about the fixed detent 20 to pivot the other free end into the opening 14 and into alignment with the ball detent 18. Thereafter, the locking mechanism is actuated to fix the ball in the position shown in FIG. 1 and lock the free end inserted through opening 14, thereby preventing withdrawal of either end from the respective openings.

Figure 3:
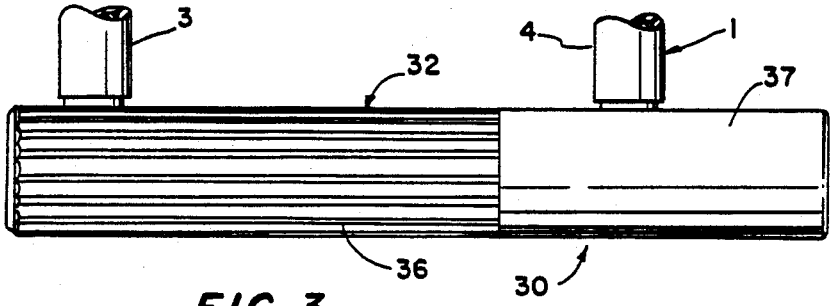
FIG. 3 is a fragmentary view in elevation of a modified lock according to the invention.
Figure 4:
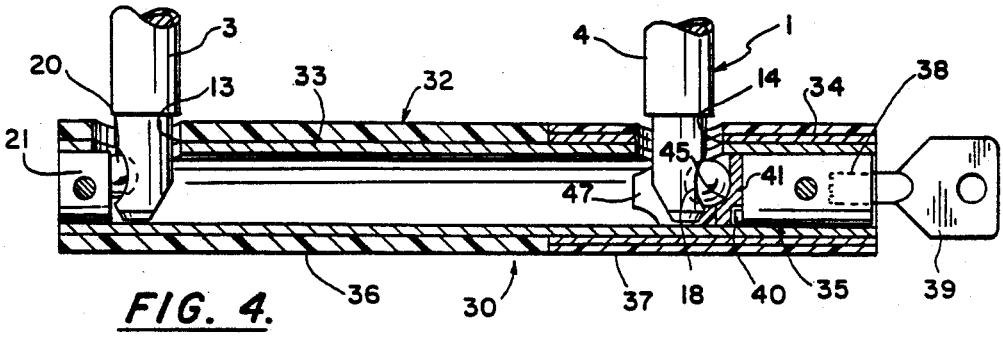
FIG. 4 is a longitudinal sectional view of the lock of FIG. 3.
Figure 7:
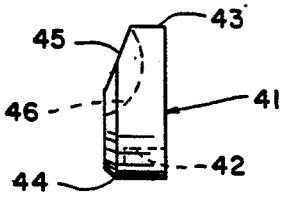
FIG. 7 is a side view in elevation of the cam of FIG. 5, shown slightly enlarged relative to FIG. 6.
Figure 6:
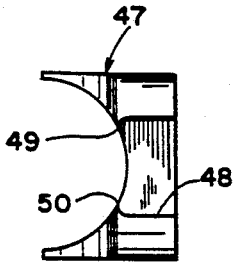
FIG. 6 is an enlarged top plan view of the ball guide and stop of FIG. 5.
Figure 5:
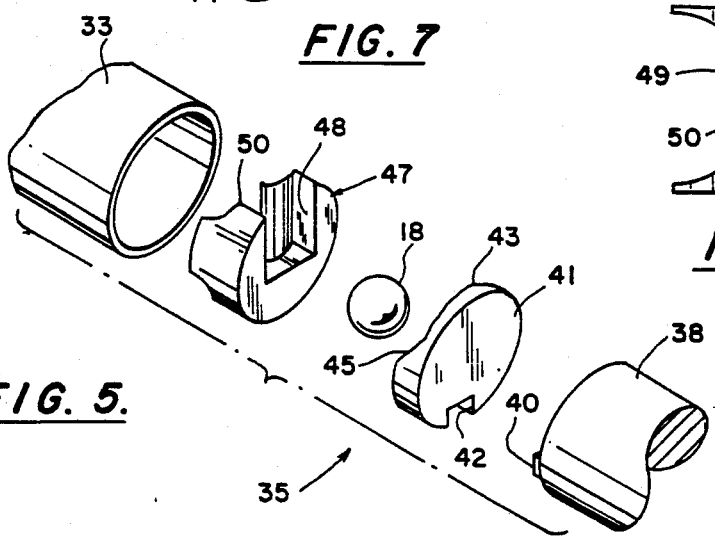
FIG. 5 is an exploded perspective view of the lock mechanism used in the lock of the invention.

A modification of the invention is indicated at 30 in FIGS. 3 through 5. This form of the invention includes a shackle 1 with legs 3 and 4 identical to that described in relation to FIGS. 1 and 2. In this form of the invention, the lock housing 32 comprises a tubular metal member 33 having openings 13 and 14 in one side thereof as previously described. In addition, a fixed detent 20 formed on plug 21 is provided in one end of the tubular member 33, as in the previously described form of the invention. However, in contrast to the first form of the invention, a heat treated protective metal sleeve 34 is provided concentrically on the end of the tubular member 33 in surrounding relation to lock mechanism 35. As seen best in FIG. 4, the protective sleeve 34 extends from the right-hand end of the housing to a point substantially beyond the opening 14 and the inner end of the lock mechanism. This sleeve protects the lock from being easily broken at the locking end of the housing. While it would be possible to make the entire housing of heat treated metal, the lock would be very expensive and heavy. The use of the sleeve provides strength where needed most, and at a reasonable weight and cost.

Rather than the continuous protective sheath or coating 15 as previously described, this form of the invention has a longitudinally ribbed protective cover 36 extending over the tubular member 33 from the inner end of the protective sleeve 34 to the left hand end of the tubular member, as viewed in FIG. 4. The ribbed design provides a more secure hand grip than the smooth configuration shown in FIG. 1. A second protective cover 37 extends from the inner end of the first cover 36 to the right hand end of the tubular member 33, as viewed in FIG. 4.

The lock mechanism 35, as seen best in FIGS. 4 and 5, comprises a barrel lock 38, which may be of conventional design and operated by a key 39, and which has a projecting pin or actuator 40 on the inner end thereof, adapted to be swung through an arc concentric with the longitudinal axis of the housing when the key is manipulated.

A cam 41 is positioned at the inner end of the barrel lock, in close-fitting relationship in the tubular member 33, and has a notch 42 in a bottom portion thereof for receiving the pin 40 on the barrel lock. Thus, when the key 39 is turned, the pin moves through an arc and, and being engaged in the notch 42, causes the cam to pivot about the longitudinal axis of the housing. The inner or forward end of the cam has a narrow upper section 43 and a wider lower section 44 joined by cam ramps 45. In addition, the forward face of the cam has a curved, concave recess or pocket 46 therein for receiving or nesting the ball detent 18 when the lock mechanism is unlocked. When the key is manipulated to lock the lock mechanism, one or the other of the cam ramps 45 engages the ball and forces it forwardly into the housing and into secure, locking engagement in the recess 19 in the shackle.

A ball stop or guide 47 is positioned forwardly of the cam 41, and has a ball guide channel 48 formed in an upper portion, with inturned ball stops 49 and 50 on the forward ends of the guide channel to limit forward movement of the ball and prevent it from becoming displaced from the lock mechanism when the shackle end is retracted from the opening 14, but yet enable the ball to enter the recess 19 in the shackle. The ball stop and guide 47 is preferably made of plastic material, although other materials may be used, as suitable.

Although the invention has been described with reference to a particular embodiment, it is to be understood that this embodiment is merely illustrative of the application of the principles of the invention. Numerous modifications may be made therein and other arrangements may be devised without departing from the spirit and scope of the invention.

I claim:

1. A tamper-resistant lock having a shackle and a housing, said shackle comprising a U-shaped member having spaced apart legs with free ends, said free ends being identically constructed and symmetrically arranged and each having means thereon for engaging and being secured by a lock mechanism in the housing, and said housing having a pair of spaced receiving means for receiving either of said ends, whereby said shackle may be assembled in locked relationship to said housing with either end thereof inserted in either of said receiving means, said lock mechanism being disposed in said housing in association with one of said receiving means for engaging and securing one end of said shackle when said one end is placed in said one receiving means, and means for securing the other end of said shackle in the other said receiving means when said lock mechanism is in engagement.

2. A lock as set forth in claim 1, wherein:

said shackle comprises a symmetrically arranged member in which said legs are parallel to one another and are joined at one of their ends by a bight portion, said free ends being on the other end of said legs and each having a beveled segment on an inner end edge thereof, and a recess in the side of said legs opposite said beveled segment, said means for securing the other of said ends in the other of said spaced means comprising a fixed detent projecting into said means for receiving the other of said ends.

3. A lock as set forth in claim 2, wherein:

said spaced means for receiving the other of said ends comprises a D-shaped opening having a curved side and a flat side, the flat side of said opening lying parallel to the plane of said beveled segment.

4. A lock comprising a housing and a symmetrically configured shackle formed with parallel legs having free ends, with the legs and free ends symmetrically shaped and sized and of equal length to one another, said free ends including beveled segments extending on the inner facing sides of said free ends, and having recesses formed in the side thereof opposite to said beveled segments, said housing having a pair of spaced receiving means for receiving either one of said free ends, one of said receiving means having a lock mechanism with a ball detent, and the other of said receiving means having a fixed detent, said fixed detent and ball detent having complementary surfaces adapted to engage and secure either one of the recesses formed in said free ends of said shackle.

5. A lock for bicycles and the like, comprising:

a U-shaped shackle having a bight portion and a pair of spaced apart, parallel legs with free ends;

an elongate tubular housing having a pair of spaced apart openings in one side thereof for receiving the free ends of said shackle;

detent means in said housing adjacent each said opening for engaging the free end of said shackle inserted in that opening, one of said detent means being fixed and the other being movable to enable the end of the shackle associated therewith to be inserted into and removed from the associated opening;

lock means in said housing in association with said other detent means to lock said detent means against movement and prevent withdrawal of said shackle end from the opening; and reinforcing sleeve means secured concentrically on said tubular housing in surrounding relation to said lock means to resist damage to said housing and lock means by tampering or the like.

6. A lock as claimed in claim 5, wherein:

the shackle is symmetrical, said legs and free ends being substantially identical to one another; and said detent means in said housing are substantially identically shaped, whereby either end of said shackle may be inserted into either of said openings in said housing.

7. A lock as claimed in claim 6, wherein:

said housing comprises an elongate tubular member, said lock means being secured in one end of said tubular member; and said detent means each comprise a ball detent, said fixed detent including a plug fixed in the other end of said tubular member.

8. A lock as claimed in claim 7, wherein:

said lock means comprises a key-operated barrel lock having a pin projecting axially from the end thereof and swingable about an arc when the key is operated, a cam member positioned at the end of the barrel lock and having means thereon adapted to cooperate with the pin whereby when the pin is swung through its arc the cam is caused to rotate through an arc, said cam having cam ramps formed thereon for engaging the ball detent to move the ball detent axially in the housing when the cam is rotated, and a ball guide and stop means positioned to guide the ball during its axial movement and to prevent displacement of the ball from its operative position when the free end of the shackle is withdrawn.

9. A lock as claimed in claim 5, wherein:

said housing comprises an elongate tubular metal member; and said reinforcing means comprises a heat treated metal sleeve disposed concentrically over said tubular member.

10. A lock as claimed in claim 9, wherein:

the shackle is symmetrical, said legs and free ends being substantially identical to one another; and said detent means in said housing are substantially identically shaped, whereby either end of said shackle may be inserted into either of said openings in said housing.

11. A lock as claimed in claim 10, wherein:

a protective rubber or rubber-like cover is placed over said housing to prevent scratching of a bicycle or the like with which the lock is used.

12. A lock as claimed in claim 11, wherein:

said protective cover comprises first and second portions, said first portion extending over the length of said tubular member from the inner end of the reinforcing sleeve and having a ribbed outer surface to facilitate gripping thereof, and the second portion extending over the length of the reinforcing sleeve.

* * * * *